US005407064A

United States Patent [19]

Huang

[11] Patent Number: 5,407,064

[45] Date of Patent: Apr. 18, 1995

[54] COIN CARRIER

[76] Inventor: Yu-Hwei Huang, 1F, No. 5, Alley 2, lane 85, Min-Tsu Rd., Lu Chou Hsiang, Taipei Hsien, Taiwan, Prov. of China

[21] Appl. No.: 274,069

[22] Filed: Jul. 12, 1994

[51] Int. Cl.[6] ..... A45C 1/00; A45C 1/10

[52] U.S. Cl. ..... 206/0.8; 206/0.81; 206/0.82

[58] Field of Search ..... 206/0.8, 0.81, 0.82, 206/45.15

[56] References Cited

U.S. PATENT DOCUMENTS

| | | | |
|---|---|---|---|
| 3,266,501 | 3/1965 | Honkey | 206/0.81 |
| 4,010,845 | 4/1977 | Bloomfield | 206/0.82 |
| 4,091,639 | 5/1978 | Benda | 206/0.82 |
| 4,915,214 | 4/1990 | Wieder | 206/0.82 |
| 5,011,005 | 4/1991 | Boyd et al. | 206/0.81 |
| 5,133,451 | 7/1992 | Boyd et al. | 206/0.81 |

*Primary Examiner*—Paul T. Sewell
*Assistant Examiner*—Tara L. Laster
*Attorney, Agent, or Firm*—Pro-Techtor International

[57] ABSTRACT

A coin carrier includes a front annular casing having a center hole, a rear annular casing having a center hole, and an intermediate annular casing connected between the front and rear annular casing and having a center hole aligned between the center holes of the front and rear annular casings, wherein the front annular casing can be turned about a movable axle pin to move the center hole thereof away from the center hole on the intermediate annular casing for permitting a coin or coins to be put into or removed from the center hole of said intermediate annular casing.

3 Claims, 6 Drawing Sheets

COIN CARRIER

BACKGROUND OF THE INVENTION

The present invention relates to a device for carrying coins and more particularly, to a coin carrier that can be fastened to a key chain for carrying coins.

Every person may spent a lot of coins daily to buy tickets, can foods, or inexpensive mall objects from vending machines, or to call a public telephone. However, it is not comfortable to carry a lot of coins in one's pockets. Further, the coins may be lost easily when they are carried in one's pockets.

SUMMARY OF THE INVENTION

The principal object of the present invention is to provide a coin carrier which can be hung on a keyring or the like to carry coins. According to the present invention, the coin carrier is comprised of a front annular casing having a center hole, a rear annular casing having a center hole, and an intermediate annular casing connected between the front and rear annular casing and having a center hole aligned between the center holes of the front and rear annular casings. The diameter of the center holes of the front and rear annular casings is smaller than that of the coins to be carried. The diameter of the center hole of the intermediate annular casing is bigger than that of the coins to be carried. The front annular casing can be turned about a movable axle pin to move the center hole thereof away from the center hole on the intermediate annular casing for permitting a coin or coins to be put into or removed from the center hole of said intermediate annular casing.

DETAILED DESCRIPTION OF THE PREFERRED EMBODIMENTS

Figure 1:
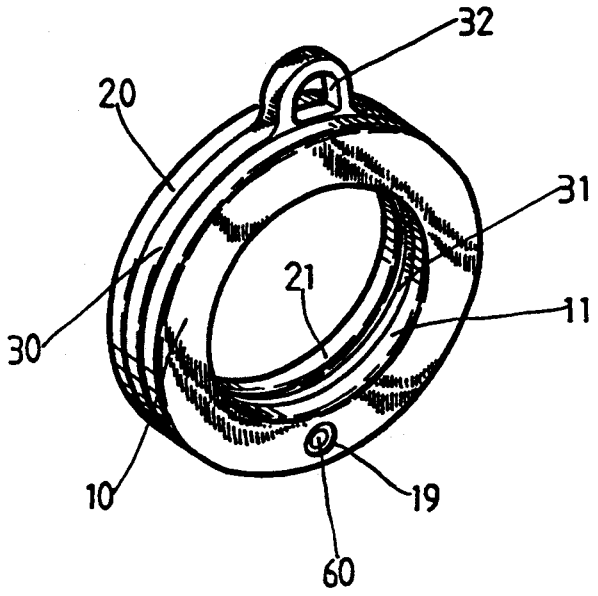
FIG. 1 is an elevational view of a coin carrier according to the preferred embodiment of the present invention.

Referring to FIG. 1, a coin carrier in accordance with the present invention is generally comprised of a front annular casing 10, a rear annular casing 20, and an intermediate annular casing 30 retained between the front and rear annular casings 10;20.

Referring to FIGS. 2, 3, 4, and 5, the front and rear annular casings 10 and 20 have a respective center hole 11 or 21 of equal diameter. The intermediate annular casing 30 has a center hole 31 concentrically aligned between the center holes 11 and 21 of the front and rear annular casings 10;20. The diameter of the center hole 31 of the intermediate annular casing 30 is bigger than that of the center holes 11 and 21 of the front and rear annular casings 10 and 20 also slightly bigger than the diameter of the coins 40 to be stored. A hanging hole 32 is made on the intermediate annular casing 30 and projected out of the periphery thereof for hanging on a keyring or any suitable device. The rear annular casing 20 and the intermediate annular casing 30 are fastened together by axle pins 50, 51 and 52. One axle pin 50 is plugged into the end hole (not show) on a hollow axle pin 54 having a round head 55. There is a movable axle pin 60 inserted through a through hole 29 on the rear annular casing 20, a through hole 39 on the intermediate annular casing 30, and a through hole 19 on the front annular casing 10, with the head 61 thereof stopped outside the rear annular casing 30. Therefore, the front, intermediate, and rear annular casings 10, 20 and 30 are connected together. The movable axle pin 60 and the axle pin 50 are disposed at two opposite locations.

Figure 4:
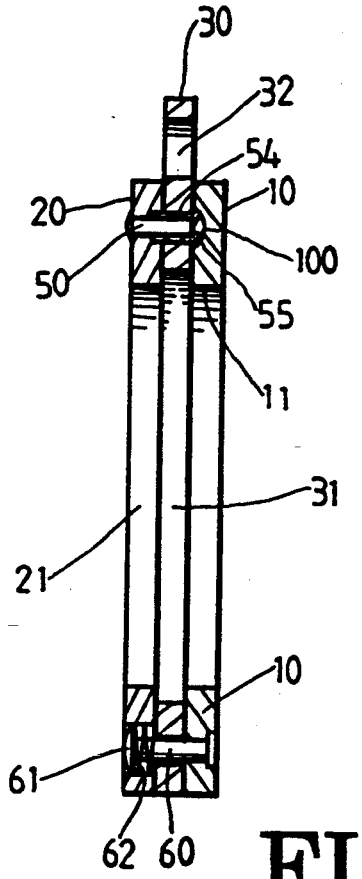
FIG. 4 is a sectional view of the coin carrier shown in FIG. 1.
Figure 5:
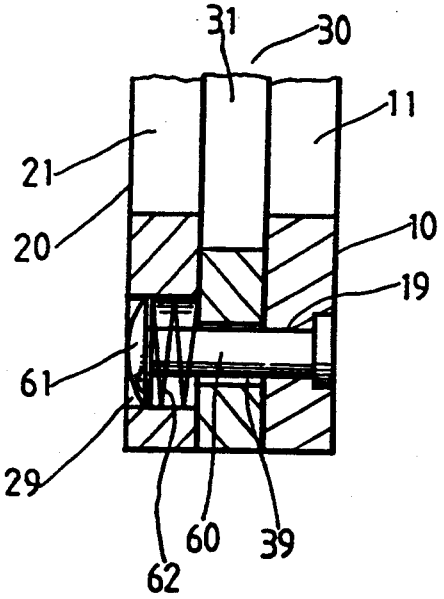
FIG. 5 is an enlarged view taken on the bottom of FIG. 4.

Referring to FIGS. 4 and 5, the through hole 29 on the rear annular casing 20 is relatively bigger than the through hole 39 on the intermediate annular casing 30. The through hole 19 on the front annular casing 10 is a stepped hole. When the plain end of the movable axle pin 60 is inserted through the stepped through hole 19, it is hammered down to form another head, and therefore the front annular casing 10 does not escape from the movable axle pin 60 and can be turned around the movable axle pin 60. Because the through hole 29 on the rear annular casing 20 is relatively bigger than the through hole 39 on the intermediate annular casing 30, therefore a spring 62 can be mounted around the movable axle pin 60 and received within the through hole 29 on the rear annular casing 20 and stopped between the head 61 of the movable axle pin 60 and the intermediate annular casing 30. When assembled, the head 55 of the hollow axle pin 54 is received in a recess 100 on the front annular casing 10.

Figure 2:
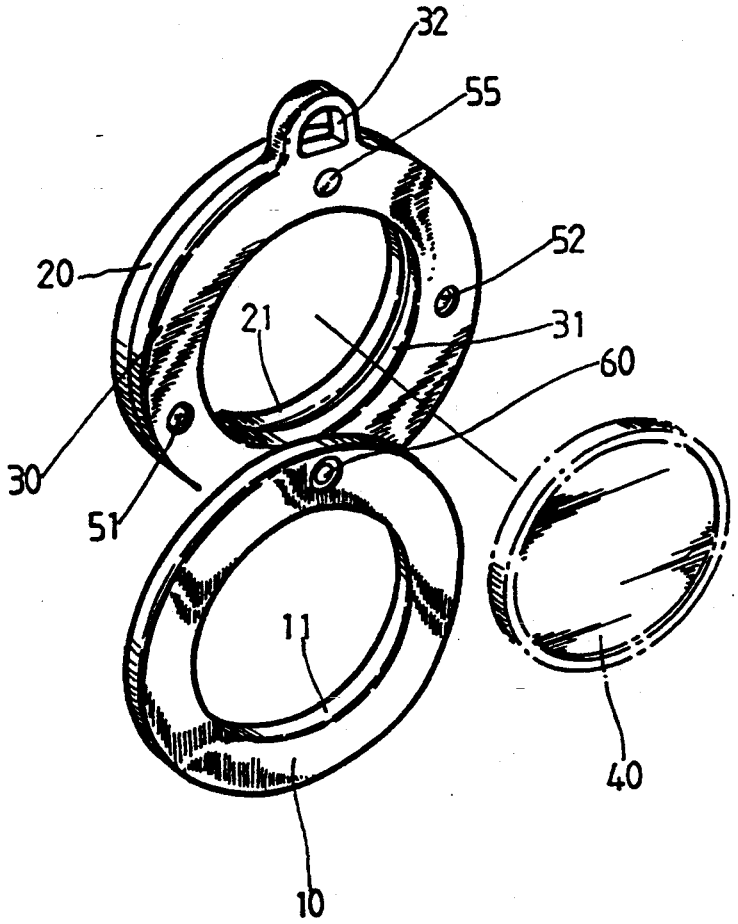
FIG. 2 is similar to FIG. 1 but showing the front annular casing thereof dismantled.
Figure 3:
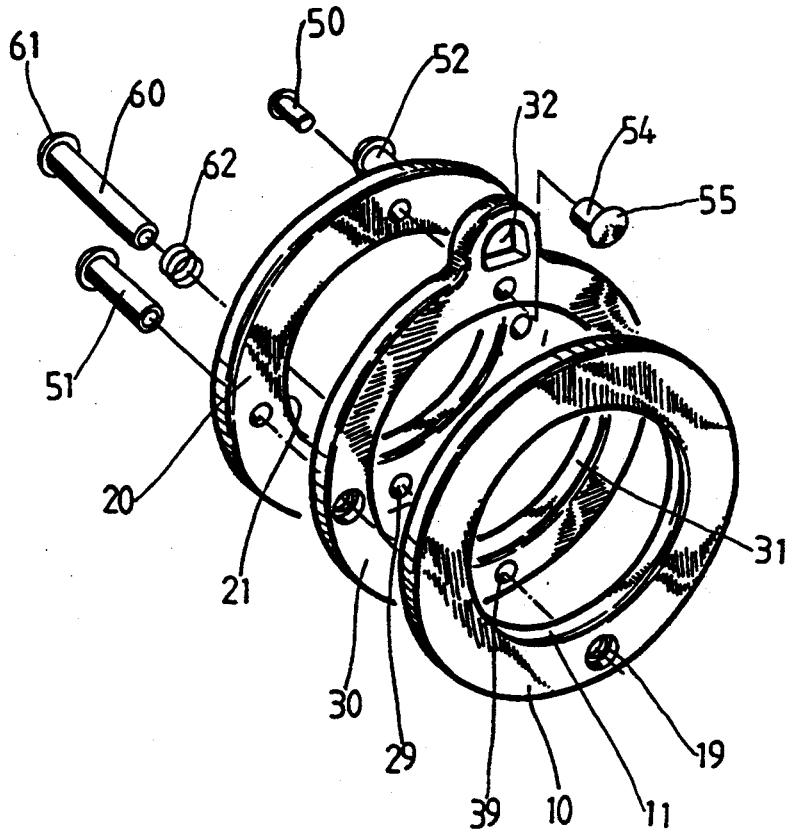
FIG. 3 is an exploded view of the coin carrier shown in FIG. 1.
Figure 6:
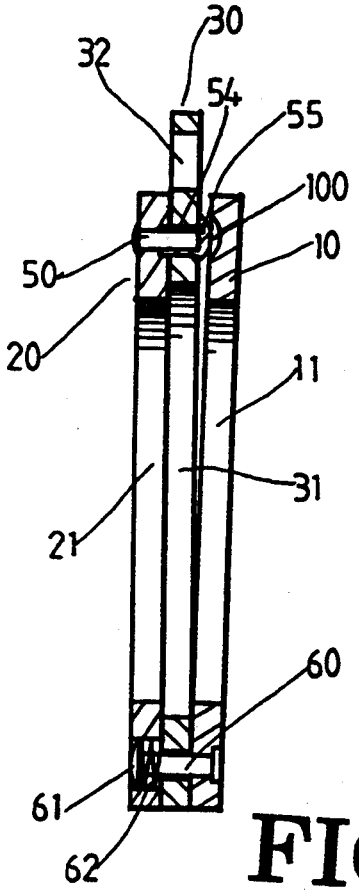
FIG. 6 is similar to FIG. 4 but showing the front annular casing displaced.
Figure 7:
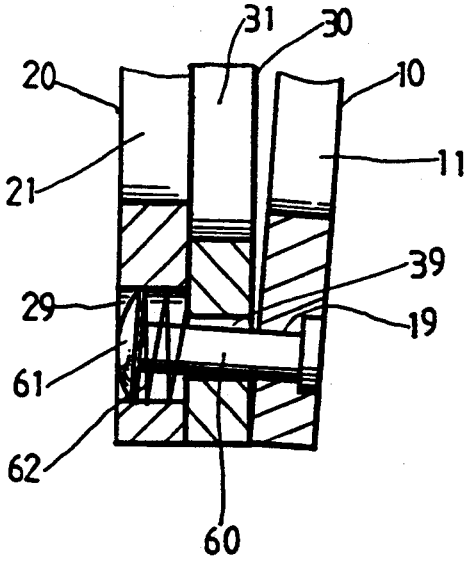
FIG. 7 is an enlarged view taken on the bottom of FIG. 6.

Referring to FIGS. 6 and 7, the front annular casing 10 is pulled outward to release the recess 100 thereof from the head 55 of the hollow axle pin 54, and therefore the front annular casing 10 can be turned about the movable axle pin 60 to move the center hole 11 thereof away from the center hole 31 of the intermediate annular casing 3 for putting a coin 40 to be put into or removed from the center hole 31 of the intermediate annular casing 3 (see FIG. 2).

Figure 8:
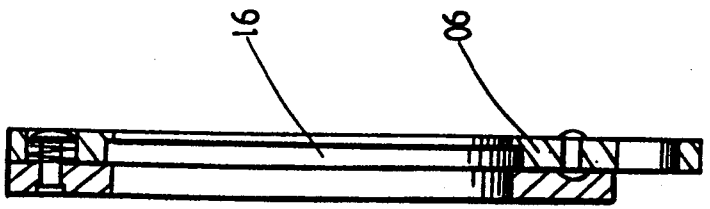
FIG. 8 is a sectional view of an alternate form of the coin carrier of the present invention.

Referring to FIG. 8, therein illustrated is an alternate form of the present invention, in which the rear annular casing and the intermediate annular casing are integrally made into a unitary casing 90 having a stepped center hole 91.

When in use, the coin carrier can be hung on a keyring or the like and carried on the belt.

What is claimed is:

1. A coin carrier comprising a front annular casing having a center hole, a rear annular casing connected to said front annular casing by a movable axle pin and having a center hole in line with the center hole on said front annular casing, an intermediate annular casing affixed to said rear annular casing at one side and having a center hole aligned between the center hole on said front annular casing and the center hole on said rear annular casing and a through hole near the border thereof through which said movable axle pin passes, said movable axle pin having one end terminated to a first head moved to slide in a through hole on said rear annular casing and an opposite end inserted through a through hole on said intermediate annular casing and a through hole on said front annular casing and terminated to a second head stopped outside said front annular casing, and a spring mounted around said movable axle and stopped between the first head of said movable axle pin and said intermediate annular casing, and wherein the diameter of the center holes of said front and rear annular casings is smaller than that of the coins to be stored, and the diameter of the center hole of said intermediate annular casing is bigger than the coins to be stored; said front annular casing can be turned about said movable axle pin to move the center hole thereof away from the center hole of said intermediate annular casing for permitting a coin or coins to be put into or removed from the center hole of said intermediate annular casing.

2. The coin carrier of claim 1 wherein said rear and intermediate annular casings are fastened together by an axle pin, said axle pin comprising a female element and a male element, said female element having a head stopped outside said intermediate annular casing and received in a recess on said front annular casing an elongated hollow body inserted into a through hole on said intermediate annular casing and a through hole on said rear annular casing, said male element having a head stopped outside said rear annular casing and an elongated solid body fitted into the elongated hollow body of said female element.

3. The coin carrier of claim 1 wherein said rear annular casing and said intermediate annular casing are made in integrity, having a respective stepped center hole aligned with each other.

* * * * *